US005577772A

United States Patent [19]

Kaiser

[11] Patent Number: 5,577,772

[45] Date of Patent: Nov. 26, 1996

[54] TANK TRUCK

[75] Inventor: Dietmar Kaiser, Schaanwald, Austria

[73] Assignee: Kaiser Akteingesellschaft, Schaanwald, Liechtenstein

[21] Appl. No.: 366,191

[22] Filed: Dec. 29, 1994

[30] Foreign Application Priority Data

Jan. 13, 1994 [AT] Austria ..... 37/94

[51] Int. Cl.[6] ..... B60P 3/22

[52] U.S. Cl. ..... 280/838; 15/302; 15/315; 137/355.12; 242/400; 242/403

[58] Field of Search ..... 280/830, 834, 280/837, 838, 839; 239/172, 173, 175, 750, 752, 753; 15/315, 302; 137/355.12, 355.16, 355.2, 355.23; 242/397, 397.1, 400, 403

[56] References Cited

U.S. PATENT DOCUMENTS 4,066,093 1/1978 Egerstrom ..... 137/355.2
4,199,837 4/1980 Fisco, Jr. ..... 15/340.1 X
4,259,066 3/1981 Pietschmann ..... 137/355.23 X
4,446,591 5/1984 Wiedemann ..... 15/315

FOREIGN PATENT DOCUMENTS 8807777 8/1898 Germany .
4113905 10/1992 Germany ..... 242/403

*Primary Examiner*—Eric D. Culbreth
*Assistant Examiner*—Victor E. Johnson
*Attorney, Agent, or Firm*—Anderson Kill Olick & Oshinsky, P.C.

[57] ABSTRACT

A tank truck including a horizontal support platform secured on the tank for supporting a suction hose, a boom secured to the support platform and supporting a free end of the suction hose, and a lead-in rotatably supported on the support platform and connecting the suction hose thereto, with the support platform being able to rotate about the rotational axis of the lead-in independently of the rotation of the lead-in.

2 Claims, 3 Drawing Sheets

TANK TRUCK

BACKGROUND OF THE INVENTION

The present invention relates to a tank truck including a horizontal support platform secured on the tank for supporting a suction hose, through which a material is sucked down into the tank, and a boom rotatable about a vertical axis and supporting a free end of the suction hose.

A tank truck of the above-described truck is shown and described in U.S. Pat. No. 4,446,591. In the tank truck, a reel for receiving a suction hose and rotatable about a vertical axis is secured on the tank. A live ring is provided on the top side of the tank in a spaced relationship to the reel. The live ring likewise rotates about a vertical axis. A lever arm, serving as a boom for the suction hose, is provided on the live ring. Because the distance between the reel and the boom or the live ring, in view of constructional and installational consideration, is relatively small, the boom can be pivoted only along a very small circumference. Therefore, the hose drum located between the reel and the boom is not strongly buckled.

Another tank truck of the above-described type instead of a reel, has a horizontal support platform for the hose, which is secured on the top side of the tank. This platform extends along the entire length of the vehicle and is fixedly secured thereto. On the rear small side of the rectangular support platform, in a corner region, a reeling device for the hose is secured. In the region of the other corner of the support platform, a hose lead-in is provided. A hose boom, rotatable about a vertical axis and having, as a rule, a variable length is provided on the tank in a spaced relationship to the support platform. In this type of tank trucks, the boom likewise pivots about a very limited circumference, and a hose drum, which is located between the reeling device and the boom, bulges too much. This type of a tank truck is described in the publication of a German firm "M üller-Umwelftechnik GmbH" (April 1989) and in the publication of a German firm "Faun-Eurotec-Vertrielsgesellshaft" (August, 1991) which manufactures waste dispose equipment.

An object of the present invention is tank truck of the above-described type, in which the boom can practically rotate about an unlimited angle, despite the presence of a hose drum between the lead-in and the boom.

SUMMARY OF THE INVENTION

This and other objects of the invention which will become apparent hereinafter are achieved by providing a tank truck in which the hose is connected to the tank with a rotatable lead-in, the boom is fixedly secured to the support platform, and the support platform is rotatable about the rotational axis of the lead-in independently of the rotation of the lead-in.

BRIEF DESCRIPTION OF THE DRAWINGS

The objects and features of the present invention will become more apparent and the invention itself will be best understood from the following detailed description of the preferred embodiments when read with reference to the accompanying drawings, wherein.

DETAILED DESCRIPTION OF THE PREFERRED EMBODIMENTS

Figure 1:
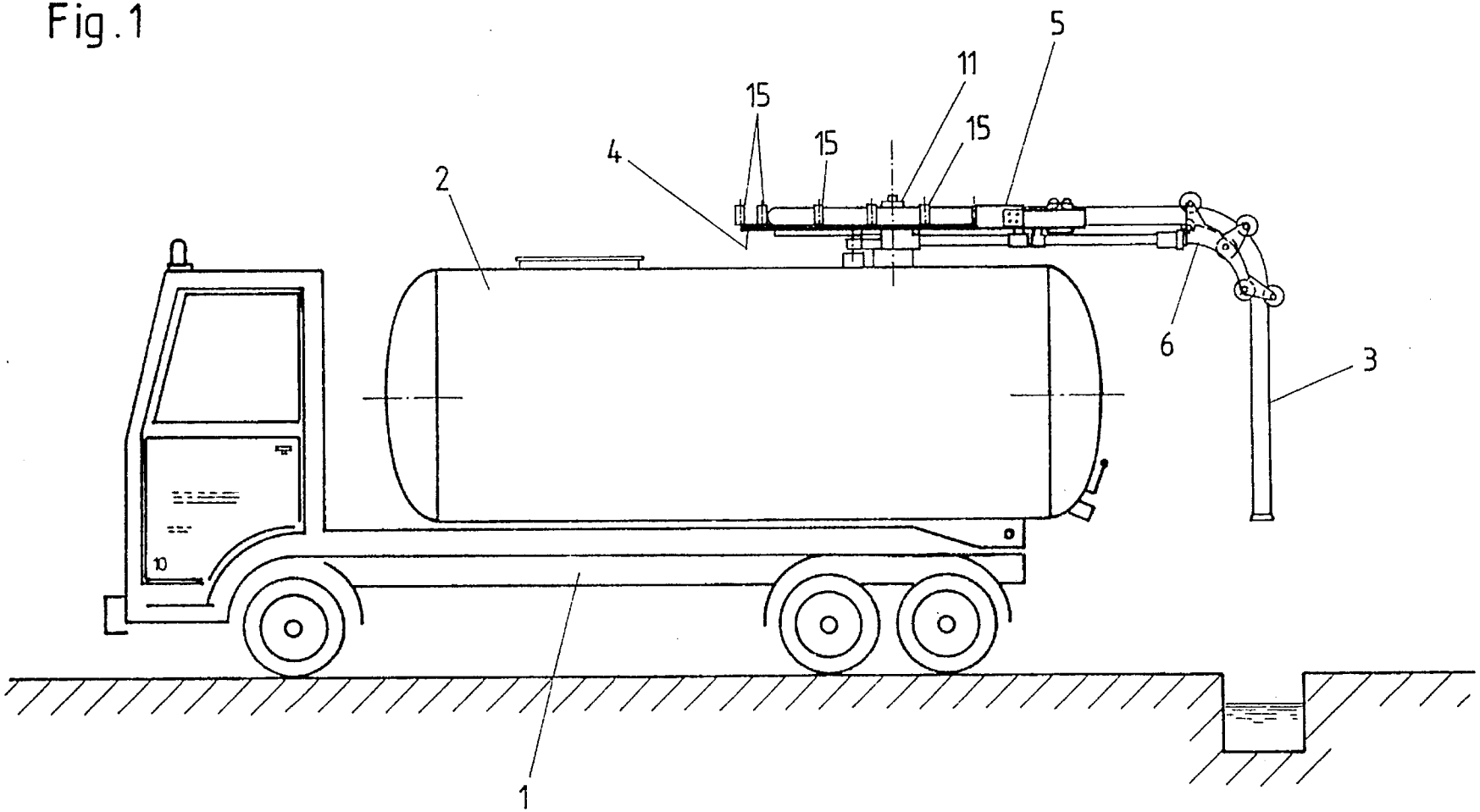
FIG. 1 shows a side view of a first embodiment of a tank truck according to the present invention.
Figure 2:
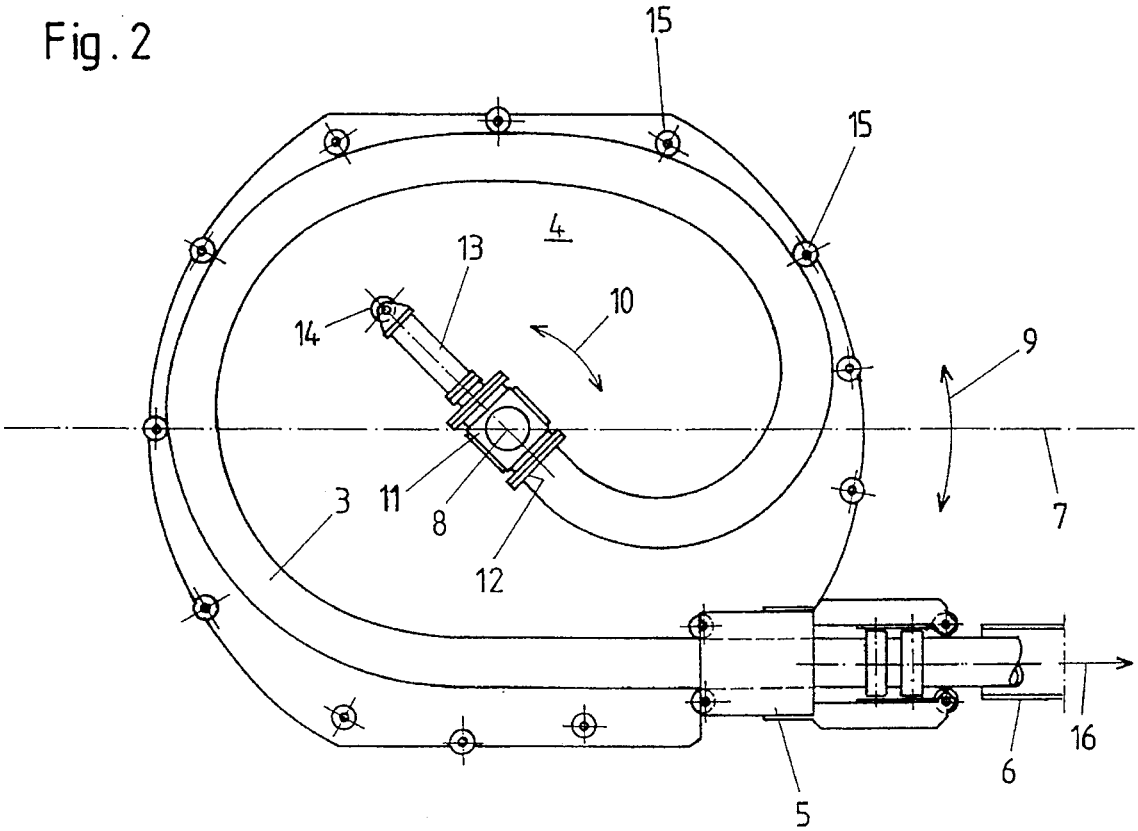
FIG. 2 shows a plan view of a support platform of a tank truck according to the present invention with a reeled-in hose.
Figure 3:
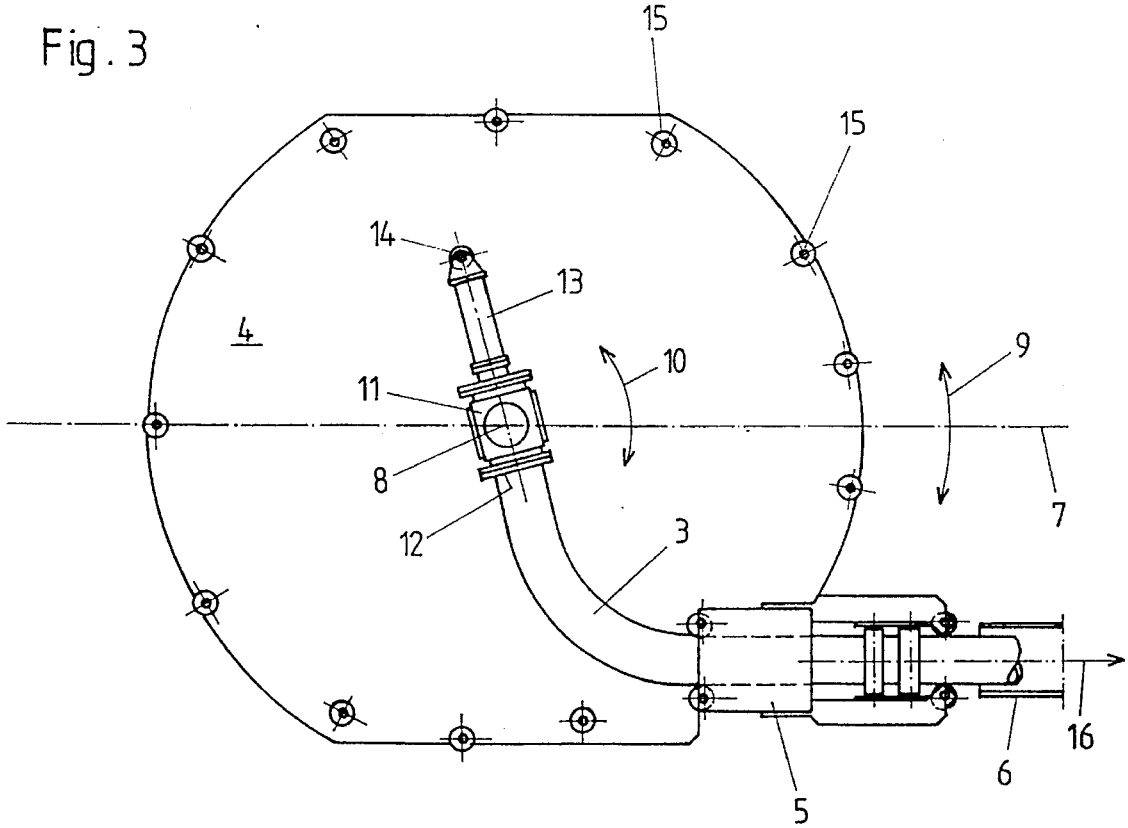
FIG. 3 shows a view similar to that of FIG. 2 but with a drawn-out hose.

A tank truck according to the present invention shown in FIG. 1, includes a vehicle chassis 1 on which a tank 2 is mounted. The tank 2 is preferably mounted with a possibility to tilt about the rear axle of the truck which is located at a right angle to the plane of the drawing. A suction hose 3 is provided for sucking the goods. The construction and operation of such tank trucks is generally known and a detailed description of them is believed to be unnecessary. On the top side of the tank 2, a horizontal support platform 4 is provided. According to the first embodiment of the tank truck, the support platform 4 is formed as a disc. A reeling device 5 for the hose 3 is arranged tangentially on the disc-shaped platform 4 and is fixedly secured thereon. The use of such devices is likewise well known. The reeling device 5 is equipped with driven rollers or belts between which the reeled-in and drawn-out suction hose is arranged. Preferably, an extendable boom 6, which has thereby a variable length, is connected to the support platform 4 or the reeling device 5. The boom 6 serves for bringing the free end of the suction hose to a location use. The longitudinal axis 7 of the tank 2 is shown in FIGS. 2 and 3 by a dash dot line. The disc-shaped support platform 4 is pivotable about a vertical axle 8 located in the center of the disc-shaped support platform 4. The support platform 4 pivots about the axle 8 as indicated by arrow 9.

A rotatable or pivotable lead-in 11 of the hose 3 is arranged coaxially with the axle 8, with the end of the hose 3 being secured on the side 12 of the lead-in 11. The plane of the mouth of the hose 3 extends perpendicular to the plane of the support platform 4. Inside the structure that forms the lead-in 11, there is located a closing cap (not shown), which is actuated by a cylinder unit 13. The cylinder unit 13 extends radially with respect to the axle 8 and parallel to the plane of the platform 4, and is diametrically arranged with respect to the connection of the hose 3. The axial length of the cylinder unit 13 corresponds approximately to a half of the radius of the disc-shaped support platform 4. The cylinder unit 13 supports at an end thereof remote from the lead-in 11 a roller 14 rotatable about a vertical axis. Along the circumference of the support platform 4, there are provided a plurality of rollers 15 rotatable about respective vertical axes. The length of the rollers 15 corresponds approximately to a half of the diameter of the hose 3. A drive motor (not shown) is provided for pivoting the support platform 4 in a direction indicated by the arrow 9.

FIG. 2 shows a plan view of the support platform with the suction hose 3 being reeled-in and lying along the rollers 15. In order to be used, the suction hose has to be drawn-out. To this end, the reeling device 5 is activated, and the boom 6 is drawn out, to the right in FIG. 2, in the direction of arrow 16. With the actuation of the reeling device 5, the hose 3, which is stored on the support platform 4, is drawn out, whereby the lead-in 11, with the support platform 4 remaining stationary, rotates or pivots about the axle 8. By the time the hose 3 is completely drawn out, the lead-in would be rotated by an angle of approximately 330°. Independently of the movement of the hose 3, the lead-in 11, and the boom 6, the support platform itself can rotate about the axle 8, so that the boom 6 with the respective end of the hose can circumscribe an angle of about 300°, without changing the position of the portion of the hose 3, which is stored on the platform 4. When the hose is reeled-in, the portion of the hose located on the support platform 4 is supported in the radial direction by the roller 14. As discussed above, the cylinder unit 13 extends parallel to the plane of the support platform 4 and radially to the mouth of the hose 3 supported in the lead-in 11.

If no adjusting or actuating element is required for the closing cap, instead of the cylinder unit 13, a cantilever arm can be provided.

The rollers 15, which are arranged along the edge of the support platform 4, facilitate displacement of the hose 3. Due to the fact that the hose 3 is supported during its displacement by the freely rotatable rollers 15, no substantial forces are required for the hose movement.

The axle 8, about which both, the support platform 4 and the lead-in 11, are rotated independently from each other, is located, in the vertical center plane of the tank 2.

Figure 4:
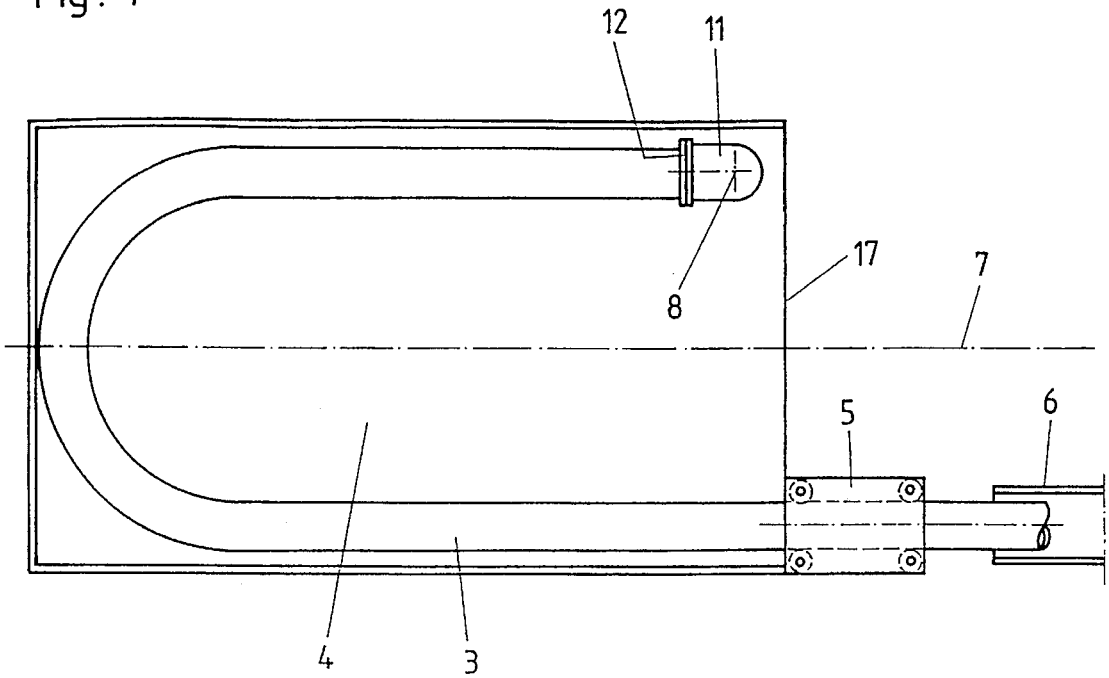
FIG. 4 shows a plan view of a support platform of another embodiment of a tank truck according to the present invention with a reeled-in hose.
Figure 5:
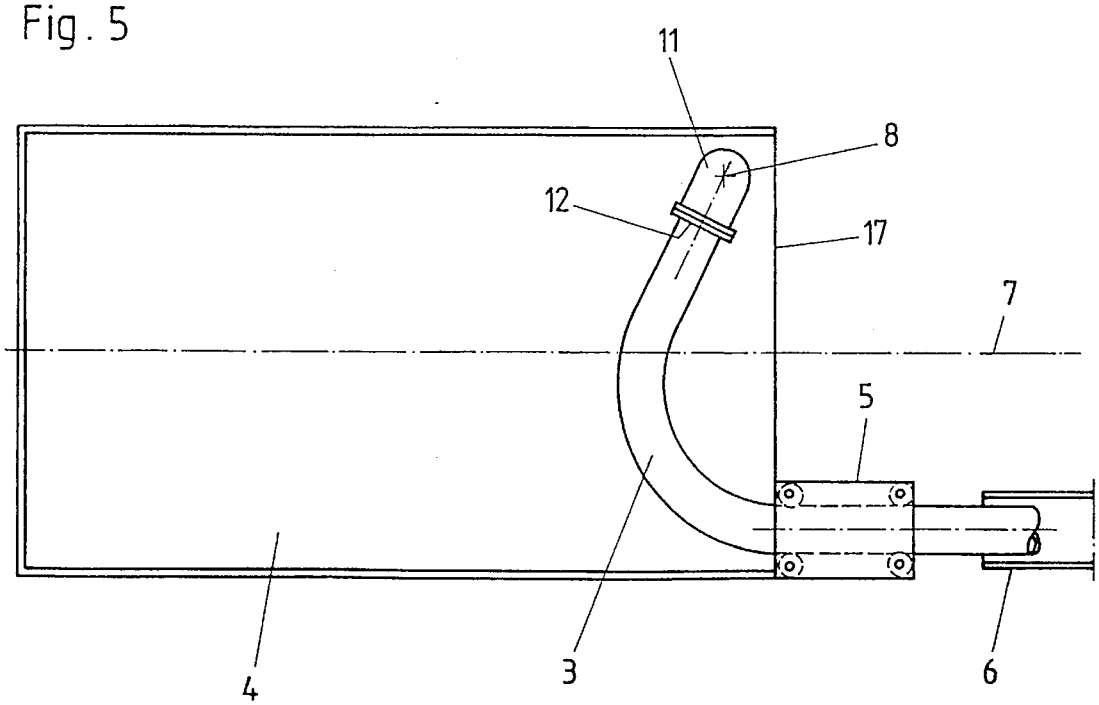
FIG. 5 shows a plan view of the support platform shown in FIG. 4 but with the drawn-out hose.

FIGS. 4 and 5 show a rectangular support platform 4 which, in its normal position, extends in a longitudinal direction of the vehicle. In the embodiment of FIGS. 4 and 5, the parts common with those shown in the embodiment of FIGS. 2 and 3, are designated with the same reference numerals. In the embodiment of FIGS. 4 and 5, the vertical axle 8, about which both, the rectangular support platform 4 and the hose lead-in 11, are rotated independently from each other, is located sidewise of the vertical longitudinal central plane of the tank 2. The hose lead-in 11 and the ruling device 5 are provided on a smaller rear side 17 of the rectangular plane of the support platform 4 at opposite corners thereof. The operation of the lead-in 11 and the ruling device 5 of the embodiment of FIGS. 4 and 5 is similar to that of the respective devices of the embodiment of FIGS. 2 and 3.

The structure according to the invention insures that the hose portion, located on the support platform 4, occupies always the same position independently of rotation of the boom 6 about the longitudinal axis 7 of the vehicle.

Though the present invention was shown and described with reference to the preferred embodiments, various modification thereof will be apparent to those skilled in the art and, therefore, it is not intended that the invention be limited by the described embodiments and details thereof, and departures may be made therefrom within the spirit and scope of the appended claims.

What is claimed is:

1. A tank truck for transporting fluid materials, comprising:

a tank for storing a fluid material;

a suction hose connected to said tank;

a substantially horizontal disc-shaped support platform secured on said tank for supporting said suction hose;

a reeling device fixedly supported on said support platform for drawing-out and reeling-in said suction hose;

a boom for supporting a free end of said suction hose and fixely supported on said platform; and a lead-in rotatably supported on said support platform for operatively connecting said suction hose with said tank and for supporting said suction hose on said support platform, said lead-in being located in a center region of said support platform, wherein said support platform is rotatable about an axis of rotation of said lead-in independently of rotation of said lead-in, and wherein said disc-shaped support platform has a circumferential edge and a plurality of rollers arranged along said circumferential edge and freely rotatable about respective vertical axes.

2. A tank truck as set forth in claim 1, wherein said rollers have a length corresponding approximately to a half of a diameter of said suction hose.

* * * * *

UNITED STATES PATENT AND TRADEMARK OFFICE

CERTIFICATE OF CORRECTION

PATENT NO. : 5,577,772

DATED : November 26, 1996

INVENTOR(S) : Dietmar Kaiser

It is certified that error appears in the above-indentified patent and that said Letters Patent is hereby corrected as shown below:

Title page, item [75], inventor: should read --Dietmar Kaiser, schaanwald, Liechtenstein--.

Signed and Sealed this

Eleventh Day of March, 1997

*Attest:*

*Attesting Officer*

BRUCE LEHMAN

*Commissioner of Patents and Trademarks*